US007605676B2

(12) United States Patent
Dabrowski et al.

(10) Patent No.: US 7,605,676 B2
(45) Date of Patent: Oct. 20, 2009

(54) DIRECTIONAL COUPLER

(75) Inventors: Jurek Dabrowski, Täby (SE); Andrzej Sawicki, Märsta (SE)

(73) Assignee: Telefonaktiebolaget LM Ericsson (publ), Stockholm (SE)

( * ) Notice: Subject to any disclaimer, the term of this patent is extended or adjusted under 35 U.S.C. 154(b) by 296 days.

(21) Appl. No.: 10/554,416

(22) PCT Filed: Apr. 20, 2004

(86) PCT No.: PCT/SE2004/000603

§ 371 (c)(1),
(2), (4) Date: Jan. 10, 2006

(87) PCT Pub. No.: WO2004/097974

PCT Pub. Date: Nov. 11, 2004

(65) Prior Publication Data

US 2006/0284700 A1 Dec. 21, 2006

(30) Foreign Application Priority Data

Apr. 25, 2003 (WO) ..... PCT/SE03/00671

(51) Int. Cl.
*H01P 5/18* (2006.01)

(52) U.S. Cl. ..... 333/116; 333/117

(58) Field of Classification Search ..... 333/116, 333/117

See application file for complete search history.

(56) References Cited

U.S. PATENT DOCUMENTS

| | | | | |
|---|---|---|---|---|
| 4,288,760 | A | 9/1981 | Beyer et al. | |
| 5,446,425 | A * | 8/1995 | Banba | 333/116 |
| 5,767,753 | A | 6/1998 | Ruelke | |
| 5,926,076 | A | 7/1999 | Johnson et al. | |
| 6,759,923 | B1 * | 7/2004 | Scott et al. | 333/116 |
| 7,030,713 | B2 * | 4/2006 | Ralph | 333/111 |

FOREIGN PATENT DOCUMENTS

| | | |
|---|---|---|
| CN | 1373533 | 10/2002 |
| EP | 0228265 | 4/1993 |
| JP | 1158801 | 6/1989 |

(Continued)

OTHER PUBLICATIONS

Office Action issued Mar. 16, 2007 in corresponding Chinese application No. 200480018020.6 (English and Chinese) explaining the relevance of Chinese Patent No. CN 1373533.

(Continued)

*Primary Examiner*—Benny Lee
(74) *Attorney, Agent, or Firm*—Nixon & Vanderhye P.C.

(57) ABSTRACT

The invention relates to a directional coupler comprising coupled lines, and a method for achieving coupling in a directional coupler under compensation conditions. The directional coupler comprises coupled lines (8, 9), including a first line (8) and a second line (9), and at least one ground plane (10, 11, 13). At least one of the ground planes is a tuning ground plane (10, 11, 13), and a distance (14, 25), between the first(8) and the second (9) line, and each distance (15, 17, 26, 27), between the first line (8) and the respective tuning ground plane (10, 11, 13), are adapted so as to contribute to a desired coupling level under compensation conditions.

10 Claims, 12 Drawing Sheets

FOREIGN PATENT DOCUMENTS

| | | |
|---|---|---|
| JP | 6045811 (A) | 2/1994 |
| JP | 6291524 (A) | 10/1994 |
| JP | 10135712 | 5/1998 |

OTHER PUBLICATIONS

Sachse et al., *Novel, Multilayer Coupled-Line Structures and Their Circuit Applications*, May 22, 2000, pp. 131-141,CPME0543780P.

IEEE Transactions on Microwave Theory and Techinques, vol. 47, No. 9, Sep. 1999, Krzysztof Sachse et al., "Quasi-Ideal Multilayer Two-and Three-Strip Directional Couplers for Monolithic and Hybrid MIC's", pp. 1873-1882.

13$^{th}$ Int. Conf. on Microwaves, Radar and Wireless Commun., MIKON-2000, Conference Proceedings, May 22-24, 2000, vol. 3, K. Sachse et al., "Novel, Multilayer Coupled-Line Structures and Their Circuit Applications", pp. 131-155.

IEEE MTT-S Int. Microwave Symposium Digest, vol. 2, Jun. 1996, M. Engels et al., "Design of quasi-ideal Couplers using Multilayer NMIC Technology", pp. 1181-1184.

IEEE Transactions on Microwave Theory and Techniques, vol. 51, No. 6, Jun. 2003, Andrzej Sawicki et al, Novel Coupled-Line Conductor-Backed Coplanar and Microstrip Directional Couplers for PCB and LTCC Applications, pp. 1743-1751.

Sachse, The Scattering Parameters and Directional Coupler Analysis of Characteristically Terminated Asymmetric Coupled Transmission Lines in an Inhomogeneous Medium, IEEE Transactions on Microwave Theory and Techniques, Vo. 38, No. 4, pp. 417-425, Apr. 1990.

Translation of Japanese Official Action, Jan. 30, 2009 in corresponding Japanese Patent Application No. 2006-508025.

Translation of Japanese official action, May 19, 2009, in corresponding Japanese Application No. 2006-508025.

* cited by examiner

DIRECTIONAL COUPLER

This application is the U.S. national phase of international application PCT/SE2004/000603, filed 20 Apr. 2004, which designated the U.S. and claims priority of PCT/SE03/00671, filed 25 Apr. 2003, the entire contents of each of which are hereby incorporated by reference.

TECHNICAL FIELD

The present invention relates to a directional coupler comprising coupled lines, and a method for achieving coupling in a directional coupler under compensation conditions.

BACKGROUND

A directional coupler is a well known four port element for radio frequency equipment. This device allows a sample of a radio or microwave frequency signal, which is provided to an input port and received at an output port, to be extracted from the input signal. Properly designed, the directional coupler can distinguish between a signal provided to the input port and a signal provided to the output port. This characteristic is of particular use in radio frequency transmitter in which both the transmitted signal and a signal reflected from a mismatched antenna can be independently monitored. To obtain such performance, directivity of the coupler should be very high. Directivity of the coupler is high if so called "compensation conditions" are fulfilled. There are two compensation conditions, assuming validity of quasi-static approximation: 1) the capacitive and inductive coupling coefficients are equal, and 2) the coupler is terminated with the proper impedances (preferably 50 Ohms)—for more details see for instance: K. Sachse, A. Sawicki, Quasi-ideal multilayer two- and three-strip directional couplers for monolithic and hybrid MICs, IEEE Trans. MTT, vol. 47, No. 9, September 1999, pp. 1873-1882. Definitions of the coupling coefficients and effective dielectric constants used in the Detailed Description can be found in: K. Sachse, The scattering parameters and directional coupler analysis of characteristically terminated asymmetric coupled transmission lines in an inhomogeneous medium, IEEE Trans. MTT, vol. 38, No. 4, April 1990, pp, 417-425, eq. (2), and the caption of FIG. 7 therein.

Directional couplers intended to be used as monitors of transmitted power or power reflected from an antenna should have weak couplings (coupling of −30 to −40 dB) and high directivity (at least 20 dB). It is a known property of directional couplers that directivity is lower for weakly coupled lines than for tightly coupled ones. Therefore, couplers having a weak coupling are difficult to make so that they are compensated. The article mentioned above by K. Sachse and A. Sawicki describes couplers that are suitable for tight couplings, in the region of −3 dB to −8 dB, corresponding to coupling levels of 0.7 to 0.4. However, weak couplings under compensation conditions can not be obtained with the configurations in the article.

A good solution for these types of couplers is utilizing pure strip line configuration with homogeneous dielectric media. Unfortunately, this solution can be applied only for couplers built as separate components. They can not, or can hardly be applied in an integrated circuit environment where transmission lines carrying a power signal are integrated mainly on the top surface of, or placed beside a multilayer printed board.

Directional couplers formed in coplanar or conductor-backed coplanar and quasi-strip line configurations are described in the U.S. Pat. No. 4,288,760 patent, and here presented in FIG. 1 and FIG. 2, respectively. It can be seen that in both configurations the coupled lines are located at a vertical distance from each other, and also at a horizontal distance from each other. Compensation of these couplers is achievable at only one mutual position of coupled strips, and the corresponding coupling is at a dozen or so dB level. In these couplers, if compensation conditions are to be kept, only a small reduction of coupling is possible by increasing the height of the dielectric layer separating the coupled strips. Moreover, the configuration shown in FIG. 1 is not convenient for multilayer boards, because positions of the external ground planes, e.g. formed by a mechanical construction, are very critical for parameters of the coupler, and small alterations of external ground plane positions will cause large deviations of the coupler parameters.

Directional couplers formed in coaxial line-microstrip printed line configurations are described in the U.S. Pat. No. 5,926,076 and EP 228265 publications. In both configurations the outer conductor of the coaxial line has a longitudinal opening, allowing coupling to a microstrip line etched on a printed circuit board and placed beside the opening. The coupling level can be adjusted in these configurations changing the horizontal distance between the inner conductor of the coaxial line and the microstrip line. However, nothing is mentioned in these publications about whether the couplers are compensated, or how to compensate them.

SUMMARY

It is an object of the invention to present a directional coupler that can assure a wide range of weak couplings realised under compensation conditions.

The object is reached with a directional coupler comprising coupled lines, including a first line and a second line, and at least one ground plane, characterised in that at least one of the ground planes is a tuning ground plane, and in that a distance, between the first and the second line, and each distance, between the first line and the respective tuning ground plane, are adapted so as to contribute to a desired coupling level under compensation conditions.

The possibility of adjusting the distance between the tuning ground plane(s) and the first line contributes substantially to possibilities of adjusting the coupling level and compensating the coupler. In turn, this makes possible to obtain high directivity of the coupler.

The technology in this case makes it possible to adjust the relationship between the distance, between the first and the second line, and each distance, between the first line and the respective tuning ground plane, so as to contribute to a desired coupling level under compensation conditions. More in particular, adjusting the distance between the tuning ground plane(s) and the first line also changes the coupling level. So, the coupling level and obtaining the compensation condition should be tuned in parallel.

Preferably, the width of the first and/or the second line are adapted so as to contribute to a desired coupling level under compensation conditions. This means that parameters also could be adjusted to reach compensation conditions. More specifically, widths of the first and the second lines can be adjusted to match the first and the second line to desired impedance, preferably 50 ohms.

In principle, four parameters can be adjusted, namely (i) the distance between the first and the second line, (ii) the distance between the tuning ground plane(s) and the first line, (iii) the width of the first line, and (iv) the width of the second line, in order to obtain equalization of capacitive and inductive coupling coefficients, and suitable values of the coupling level, impedance of the first line, and impedance of the second line.

Preferably, the second line and the respective edge of the at least one ground plane are located on the same side of the first line. This will facilitate compensating the coupler by adjusting the distance between the respective edge of the at least one ground plane and the first line.

Preferably, the directional coupler comprises at least two conductive layers, whereby at least one dielectric layer is interposed between the conductive layers. Thereby, the coupler configuration is convenient to be manufactured in a standard multilayer printed circuit board technology. In other words, a directional coupler configured in multilayer printed circuit environment that can assure a wide range of weak couplings realized under compensation conditions is presented.

Preferably, an electrical length of the directional coupler is a quarter or less of the wavelength.

Preferably, the first line comprises at least two strips separated in a vertical direction and electrically joined by at least one connection. Thereby, it is possible to obtain the first line with a low insertion loss and that can carry a high power of a transmitted signal. Additionally, where dielectric material is used to separate the strips and is milled out so that a so-called quasi-air line is created, almost no dielectric losses occur, since the conductive layers, or strips, have the same electrical potential, and the electromagnetic field doesn't penetrate the dielectric material.

Preferably, a region between the first and the second lines comprises at least partly a gas, and at least one dielectric layer is arranged between the second line and the at least one tuning ground plane, whereby each distance between the first line and the respective tuning ground plane is dependent on the respective distance between each tuning ground plane and a boundary between the gas and the dielectric layer. The first line can be surrounded completely by the gas, and the second line can be imbedded in at least one dielectric material, or the second line can be in partial contact with the gas and partial contact with the dielectric material. Thereby, the power handling capability of the first line is further increased.

The object is also reached with a method for achieving coupling in a directional coupler under compensated conditions, the coupler comprising coupled lines including a first and a second line, and at least one ground plane, characterised in that the method comprises choosing a distance, between the first and the second line, and each distance, between the first line and an edge of at least one of the ground planes, so as to contribute to a desired coupling level under compensation conditions.

This method is very useful when designing a directional coupler, or when adjusting an existing coupler or coupler design, in order to achieve a wide range of weak couplings realised under compensation conditions.

BRIEF DESCRIPTION OF DRAWINGS

Below, the invention will be described in detail with reference to the drawings, in which.

DETAILED DESCRIPTION OF NON-LIMITED EXAMPLE EMBODIMENTS

Figure 1:
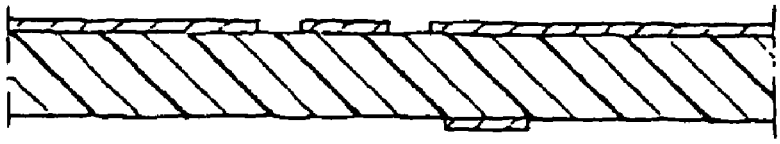
FIG.1 (PRIOR ART)
FIGS. 1 and 2 show sectional views of coupled lines directional couplers according to known art, sectioned perpendicular to the coupled lines.
Figure 2:
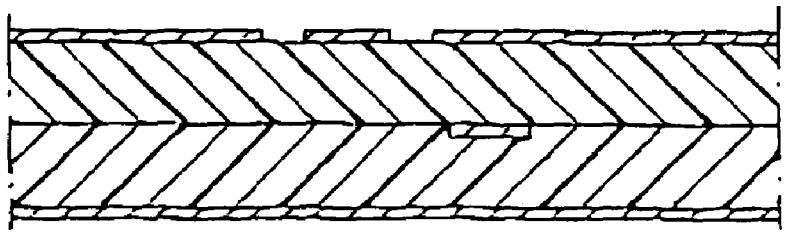
FIG.2 (PRIOR ART)
Figure 3:
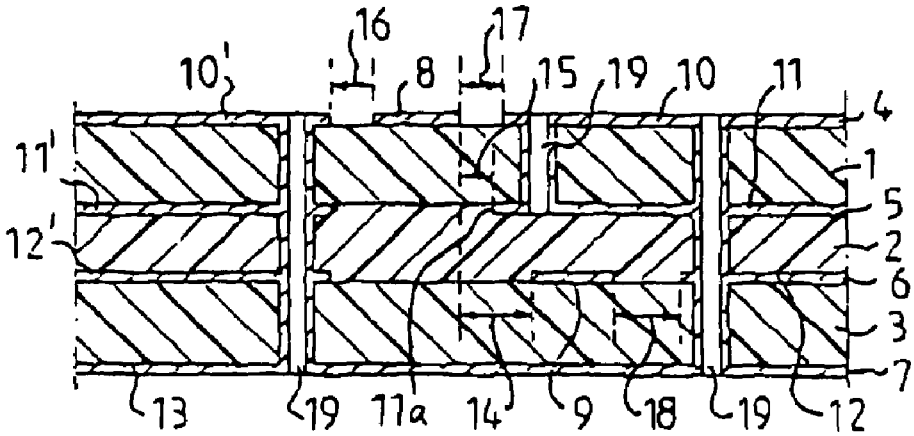
FIG. 3 shows a sectional view of a coupled lines directional coupler according to a first embodiment, sectioned perpendicular to the coupled lines.

In FIG. 3, cross-section of a structure of a coupled lines directional coupler according to a first non-limited example embodiment is presented. Like other non-limited example embodiments, it is suitable for multilayer printed circuit technologies and weak couplings. It comprises a first dielectric layer 1, a second dielectric layer 2 and a third dielectric layer 3 in the form of substrates. The first dielectric layer 1 is located above the second dielectric layer 2, and the second dielectric layer 2 is located above the third dielectric layer 3. The coupler comprises a first conductive layer 4, a second conductive layer 5, a third conductive layer 6 and a fourth conductive layer 7. The first conductive layer 4 is located on top of the first dielectric layer 1. The second conductive layer 5 is located between the first dielectric layer 1 and the second dielectric layer 2. The third conductive layer 6 is located between the second dielectric layer 2 and the third dielectric layer 3. The fourth conductive layer 7 is located below the third dielectric layer 3.

Coupled lines 8, 9, in the form of strips, preferably straight and parallel, and having a longitudinal axis, here referred to as a first line 8 and a second line 9, are formed in the first conductive layer 4 and the third conductive layer 6, respectively. In the description of example embodiments, the first line 8 is also referred to as a main line.

In any embodiment, the first and second lines could also be arranged so that the distance between them varies, for example in a case where one of them, or both, are tapered or curved, or in a case where they are straight but non-parallel. For this presentation, the longitudinal axis of the coupled lines is defined as the longitudinal direction of the mass distribution of both lines. In a case where the coupled lines are straight and parallel, the longitudinal axis of the coupled lines is parallel to each of them.

The first and the second line 8, 9 are located at a horizontal distance 14 from each other. In this embodiment, since the first and the second line 8, 9 are formed in separate conductive layers, they are also located at a vertical distance from each other, which is approximately equal to the sum of the thicknesses of the first 1 and the second 2 dielectric layer.

In the first conductive layer 4, second conductive layer 5, third conductive layer 6 and fourth conductive layer 7, a respective first ground plane 10, 10', second ground plane 11, 11', third ground plane 12, 12' and fourth ground plane 13 are formed. The fourth ground plane 13 is also referred to as a lower ground plane 13. The first ground plane 10, 10', second ground plane 11, 11', and third ground plane 12, 12' ground plane each include a first region 10, 11, 12, and a second region, 10', 11', 12', which are, in a direction parallel to the ground planes and perpendicular to the longitudinal direction of the coupled lines 8, 9, located on opposite sides of the first line 8.

The second regions of the first, second and third ground plane 10', 11', 12', located on the same side of the first line 8, are preferably located at the same horizontal distance 16 from the first line 8. This will be practical, since it will facilitate the introduction of a plurality of connections 19, or via holes 19, connecting the second regions 10', 11', 12' and the lower ground plane 13, the via-holes being located along a line parallel to the coupled lines 8 and 9. However, as an alternative, the second regions of the first, second and third ground plane 10', 11', 12' could be located at un-equal horizontal distances from the first line 8.

The horizontal distance 16 between the second regions 10', 11', 12' of the first, second and third ground planes and the first line 8 can be adjusted to achieve the desired impedance of the first line.

The first region of the second ground plane 12, which is located on the same side of the first line 8 as the first region of the second ground plane 11, is located at a distance 18 from the second line 9. The first region of the first ground plane 10, second ground plane 11, and third ground plane 12 and the lower ground plane 13 are connected by means of a plurality of via holes 19 placed along a line parallel to the coupled lines 8 and 9.

The first region of the second ground plane 11, which is, in a direction parallel to the ground planes and perpendicular to the longitudinal direction of the coupled lines 8, 9, located on the same side of the first line 8 as the second line 9, is here referred to as a tuning ground plane 11.

As can be seen in FIG. 3, the tuning ground plane 11 is, located between the first line 8 and the second line 9 and extends in a direction that is perpendicular to the direction of the first line 8 and the second line 9. The first line 8 and the tuning ground plane 11, formed in separate conductive layers, are located at a vertical distance from each other, which is approximately equal to the thickness of the first dielectric layer 1.

Figure 4A:
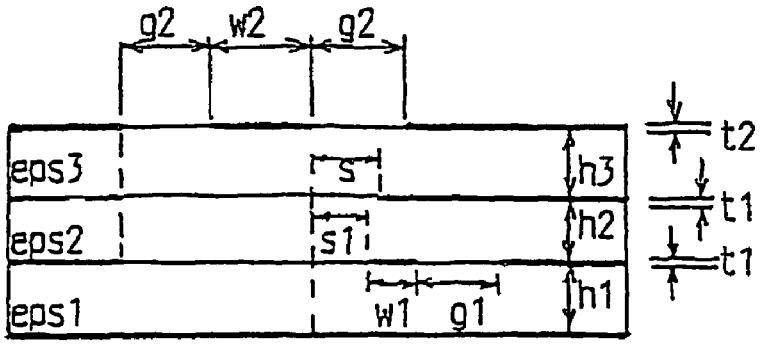
FIG. 4*a* shows a cross-section corresponding to the one in FIG. 3 to explain variables in the diagram of FIG. 4.

As described further below with reference to FIGS. 4 and 4*a*, a horizontal distance 15 between the first line 8 and an edge 11*a* of the tuning ground plane 11 is adjusted to achieve compensation conditions for a wide range of weak couplings as shown in FIG. 3.

The first region 10 of the first ground plane is placed at the same distance 17 (see FIG. 3) from the first line 8 as the second region 10'. However, as an alternative, the distances 16, 17 between the first region 10 of the first ground plane and the first line 8, and the second region 10' of the first ground plane and the first line 8 could be un-equal. In fact, the first region 10 of the first ground plane could be used a supplementary tuning ground plane, whereby the distance 17 between the edge of the first region 10 of the first ground plane and the first line 8 could be adjusted along with the distance 15 between the first region 11 of the second ground plane and the first line 8 to achieve compensation conditions for a wide range of weak couplings.

Figure 4:
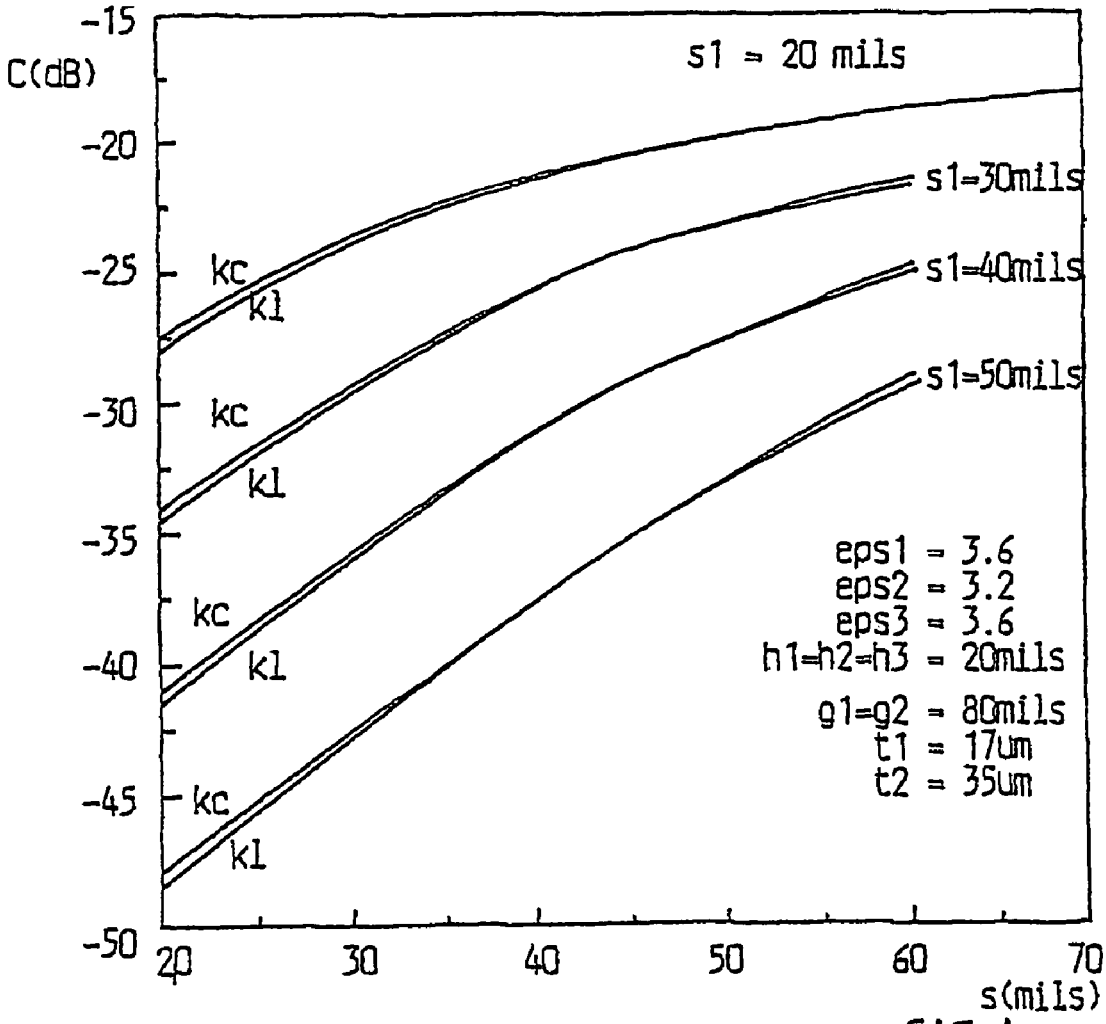
FIG. 4 shows a diagram with coupling coefficients for the directional coupler shown in FIG. 3.

FIG. 4 shows results of calculations of the coupling coefficients C of the coupler described above, as a function of the horizontal distance 15 between the first line 8 and the tuning ground plane 11 (FIG. 3), and the horizontal distance 14 between the first line 8 and the second line 9 as a parameter. The permittivity of the dielectric layers is referred to as eps1, eps2, and eps3. eps1 and eps3 values are typical for a core material, and eps2 value is typical for a prepreg material as shown in FIG.4B. As shown in the curves of FIG.4, kc and kl refer to the capacitive and inductive coupling coefficients, respectively. The directional coupler is compensated if these two coefficients are equal and the ports of the coupler are terminated, in this case with 50 Ohms impedance. It can be seen in FIG. 4 that the configuration assures wide range of weak couplings, i.e. from −20 dB to −37 dB and beyond, while being compensated. To clarify that these are weak coupling levels, it is pointed out that −20 dB correspond to a ratio between the power transferred to the second line 9 and the total power propagated in the main line 8 of 0.01, and −30 dB correspond to a ratio between the power transferred to the second line 9 and the total power propagated in the main line 8 of 0.001. The ground plane 11 has a central function in adjusting the coupling level and to compensate the coupler. The coupling level can be adjusted by changing the distance 14 between the first line 8 and the second line 9 and adjusting the distance 15 between the first line 8 and the tuning ground plane 11. The adjustment of the distance 15 between the first line 8 and the tuning ground plane 11 will also tune the coupler to the compensation conditions. At the same time width of the first line 8 and the second line 9 should be adjusted to fulfil the matching condition of the compensation conditions. These widths vary from 120 to 126 mils for the line 8 and from 21 to 31 mils for the line 9 when the first 14 and the second 15 horizontal distances vary over the range shown in FIG.4.

Figure 5:
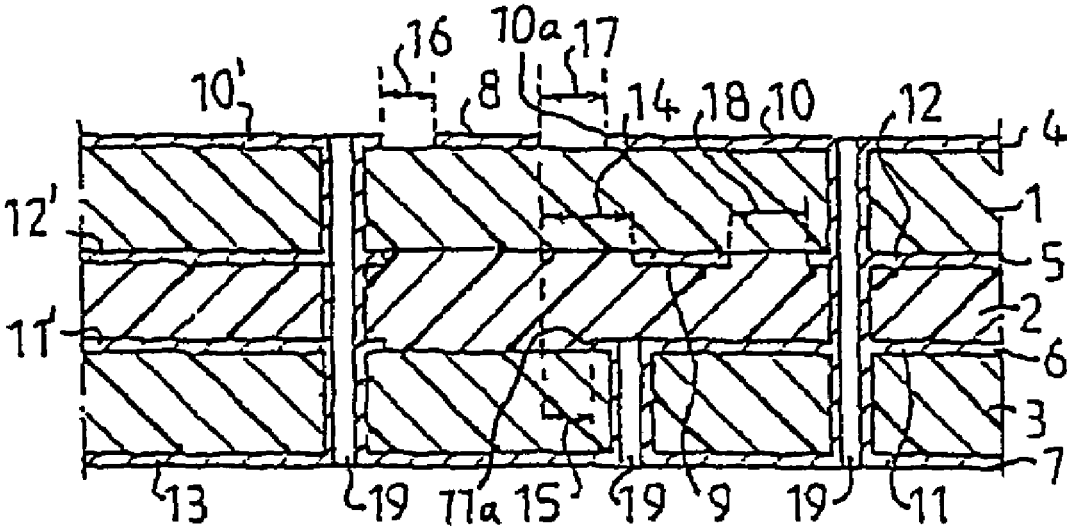
FIG. 5 shows a sectional view of a coupled lines directional coupler according to a second embodiment, sectioned perpendicular to the coupled lines.

FIG. 5 shows a directional coupler according to a second embodiment. The physical configuration of the second embodiment is similar to the first embodiment described with reference to FIG. 3, except for the following. Differing from the first embodiment, the second line 9 is formed in the second conductive layer 5. Thus, in this embodiment, the vertical distance between the coupled lines is approximately equal to the thickness of the first dielectric layer 1. Further, differing from the denotation used with reference to FIG. 3, in the third conductive layer 6 a second ground plane 11, 11' is formed, and in the second conductive layer 5, a third ground plane 12, 12' is formed. The second line 9 is, in a direction perpendicular to the ground planes, located between the first line 8 and the first region of the second ground plane 11. The vertical distance between the first line 8 and the first region of the second ground plane 11 is approximately equal to the sum of the thicknesses of the first dielectric layer 1 and the second dielectric layer 2.

The first region 10 of the first ground plane and the first region of the second ground plane 11 are referred to as tuning ground planes and are both, in a direction parallel to the ground planes and perpendicular to the longitudinal direction of the coupled lines 8, 9, located on the same side of the first line 8 as the second line 9. Also, the first line 8 and tuning ground plane 11 are located at a horizontal distance 15 from each other, and the first line 8 and tuning ground plane, 10 are located at a horizontal distance 17 from each other. Thus, in this embodiment, the coupler is tuned for compensation by adjusting the horizontal distances 17, 15 between first line 8 and an edge 10*a* of the first region 10 of the first ground plane and an edge 11*a* of the first region 11 of the second ground plane, respectively.

As an alternative, only the distance 15 can be adjusted for compensation, whereby the first region 10 and the second region 10' of the first ground plane could be placed with preferable equal distances 16, 17 from the first line 8.

Figure 6A:
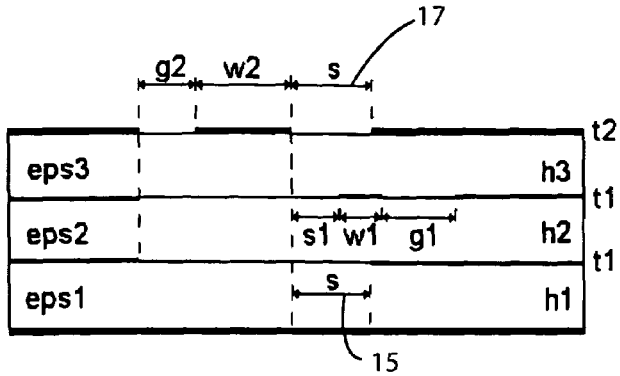
FIG. 6*a* shows a cross-section corresponding to the one in FIG. 5 to explain variables in the diagram of FIG. 6.
Figure 6:
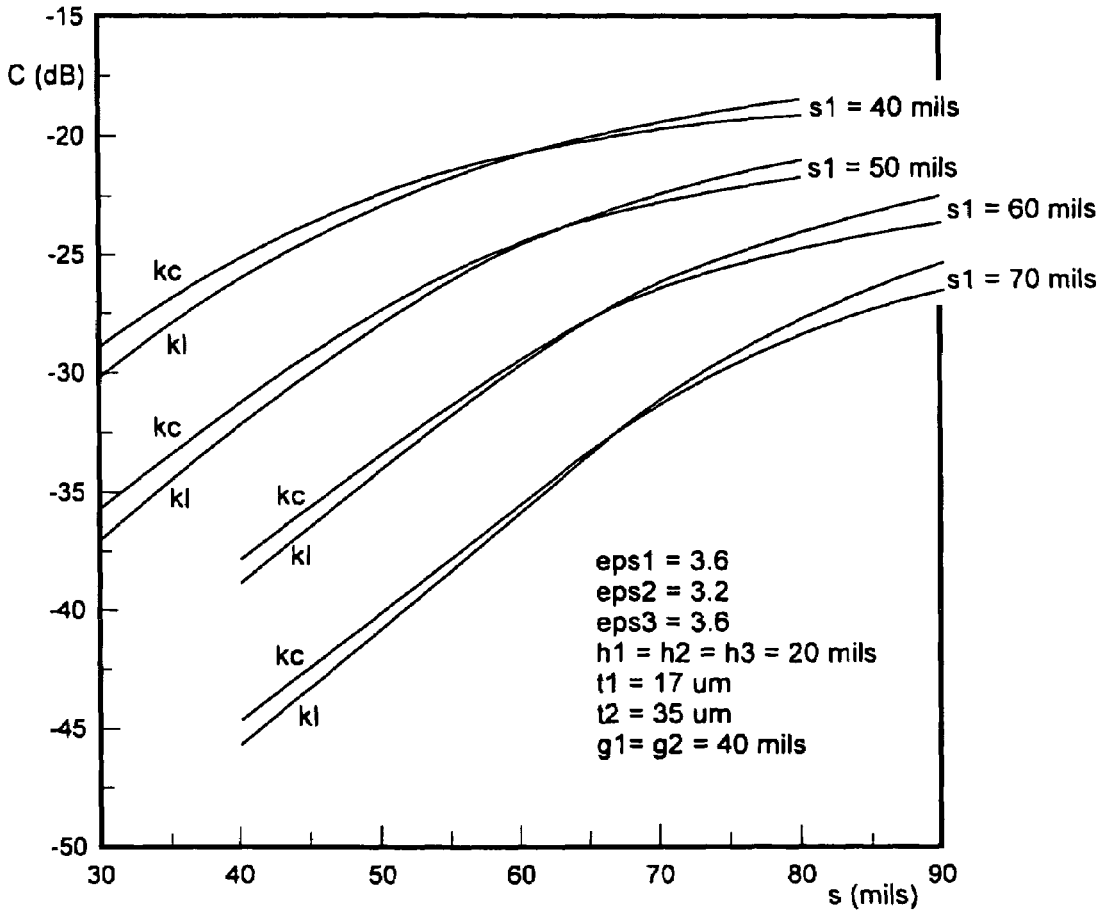
FIG. 6 shows a diagram with coupling coefficients for the directional coupler shown in FIG. 5.

FIG. 6 shows results of calculations of the coupling coefficients, of the coupler described with reference to FIG. 5, as a function of the horizontal distances 15, 17 (s) (see FIG. 6*a*) between the first line 8 and the tuning ground planes 10, 11, and the horizontal distance 14 between the first 8 and the second 9 line as a parameter (s1) (see FIG. 6*a*. Thus, in FIG. 6 the results are obtained by setting the horizontal distance 17 (see FIG. 5) between the first line 8 and the tuning ground plane 10 equal to the horizontal distance 15 between the first line 8 and the tuning ground plane 11.

It can be seen in FIG. 6 that with the coupler according to the second embodiment essentially the same wide range of weak couplings is achievable while the coupler is compensated, as with the coupler according to the first embodiment. Accompanying widths of the first line 8 and the second line 9, assuring the matching to 50 Ohms condition, vary from 104 to 130 mils and from 21 to 40 mils, respectively.

In the first and second embodiments, presented with reference to FIGS. 3 and 5, respectively, the configurations utilized the conductor-backed coplanar line 8 on the first conductive layer 4 and quasi strip line 9 on the third 6 or on the second 5 conductive layer.

Figure 7:
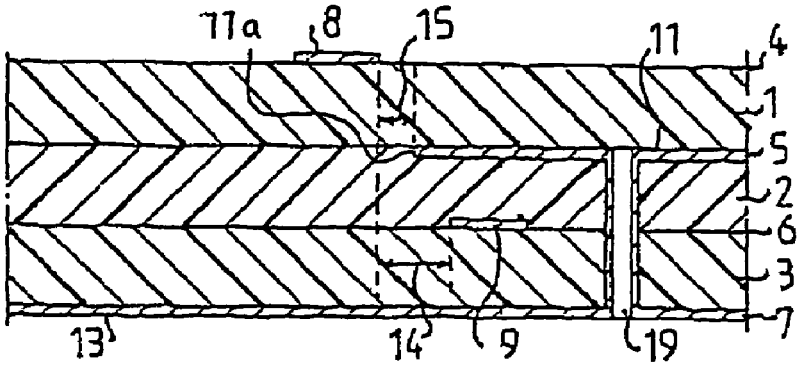
FIG. 7 shows a sectional view of a coupled lines directional coupler according to a further embodiment, sectioned perpendicular to the coupled lines.

FIG. 7 shows a further embodiment, in the form of a microstrip-quasi strip line configuration, whereby positions of a first line 8, a second line 9 and a tuning ground plane 11 correspond to the positions of the respective corresponding elements in the configuration shown in FIG. 3. A lower ground plane 13 is present below the second line 9. The embodiment shown in FIG. 7 differs from the embodiment shown in FIG. 3 in that, at least in a vicinity of the coupled lines 8, 9, there are no ground planes at conductive layers in which the first line 8 and the second line 9 are formed. Also, a part corresponding to the second region 11' of the second ground plane in the embodiment shown in FIG. 3 is not present in the embodiment shown in FIG. 7. In the embodiment in FIG. 7, the first line 8 and the lower ground plane 13 form a microstripline configuration, in which the first line 8 is a microstripline 8, and the second line 9, the tuning ground plane 11 and the lower ground plane 13 form a stripline configuration, in which the second line 9 is a quasi strip line 9.

Figure 8A:
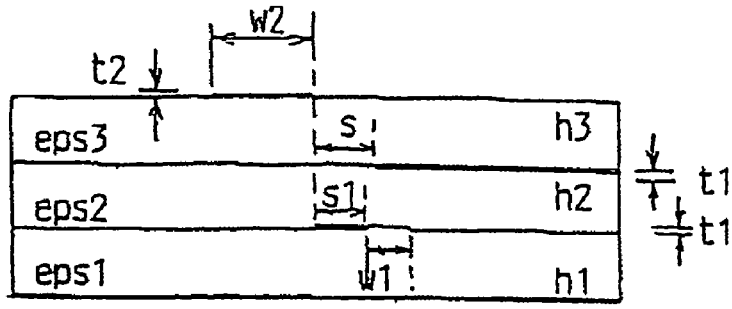
FIG. 8*a* shows a cross-section corresponding to the one in FIG. 7 to explain variables in the diagram of FIG. 8, FIG. 9-13 show sectional views of coupled lines directional couplers according to additional embodiments, sectioned perpendicular to the coupled lines.
Figure 8:
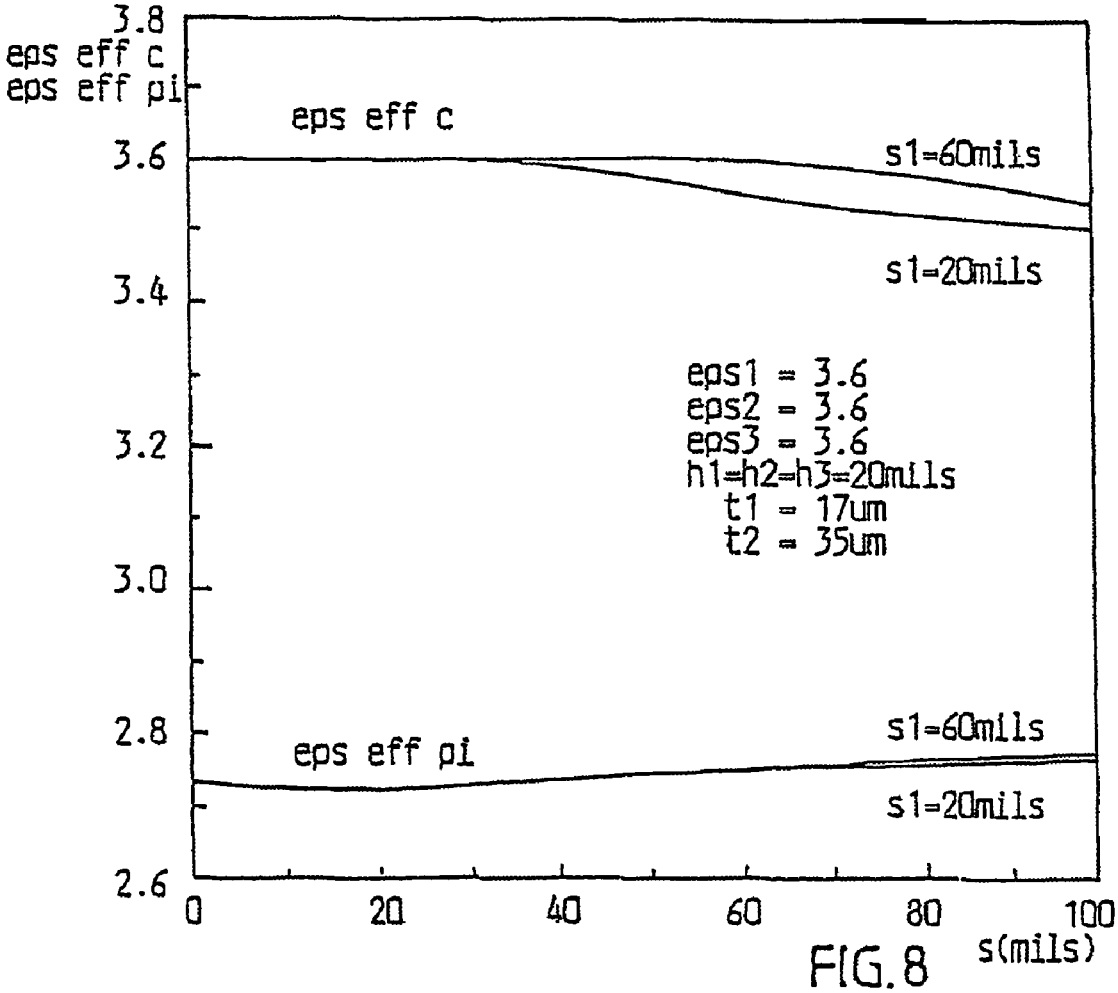
FIG. 8 shows a diagram with effective dielectric constants calculated for two orthogonal modes propagated in the coupled lines in the configuration shown in FIG. 7.

Surprisingly, it has been found that weak couplings at compensation conditions can be obtained with a big difference in propagation velocities of two orthogonal modes propagated in the coupled lines. This is illustrated in FIGS. 8 and 8*a*, in which effective dielectric constants (eps eff c and eps eff pi) calculated for two orthogonal modes c and pi propagated in the coupled lines in configuration shown in FIG. 7, and a cross-section corresponding to the one in FIG. 7 to explain variables in the diagram, are presented. Dielectric permittivity of the dielectric layers is chosen to be the same for each layer, and equal to 3.6. In FIG. 8, eps eff c corresponds to the wave propagated in the stripline 9. Notice, that if the stripline 9 is covered with the tuning ground plane 11, which corresponds to small values of s, effective dielectric constant for this mode is equal to the dielectric permittivity of the dielectric layers, as it should be for the stripline 9. eps eff pi corresponds to the wave propagated in the microstripline 8 and differs very much from eps eff c.

Further modifications of the configurations described above are possible within the scope of the present invention. On the side of the first line 8 opposite to the side where the second line 9 and the tuning ground plane 11 are positioned, any arrangement of the ground planes 10', 11' and 12' is possible. Thereby only some of the ground planes 10', 11' and 12' can be present, or all of them can be omitted. The ground planes positioned at the vicinity of the first 8 or the second line 9 can be useful for tuning these lines to the terminating impedance (50 Ohms) at convenient geometrical dimensions.

Figure 9:
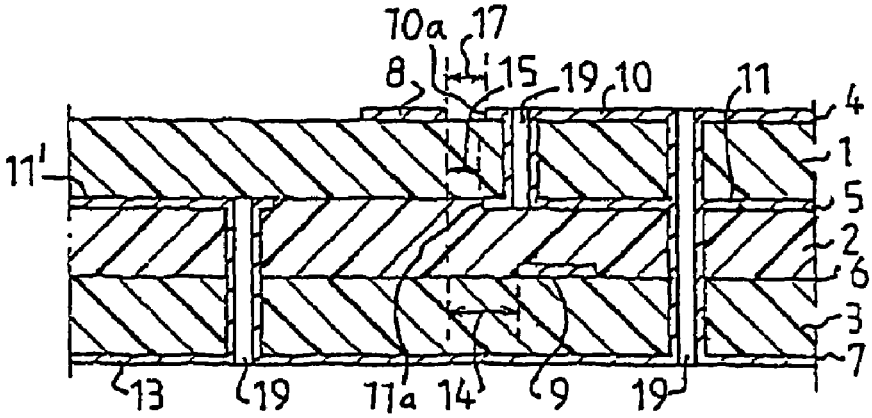

FIG. 9 shows an alternative configuration in which positions of a first line 8, a second line 9 and a tuning ground plane 11 corresponds to the positions of the respective corresponding elements in the configuration shown in FIG. 7. Additionally, a second ground plane region 11' formed in the same conductive layer as the tuning ground plane is presented, in a horizontal direction, on the opposite side of the first line 8. Also, in a horizontal direction, on the same side of the first line 8 as the tuning ground plane 11, a first ground plane 10 is formed on the same conductive layer as the first line 8, and located at a distance 17 from the first line 8. The first ground plane 10 can be used as a supplementary tuning ground plane, whereby compensation conditions for a wide variety of weak couplings can be achieved by suitable adjustment of the horizontal distance 15 between an edge 11*a* of the tuning ground plane 11 and the first line 8, as well as the horizontal distance 17 between an edge 10*a* of the tuning ground plane 10 and the first line 8.

Figure 10:
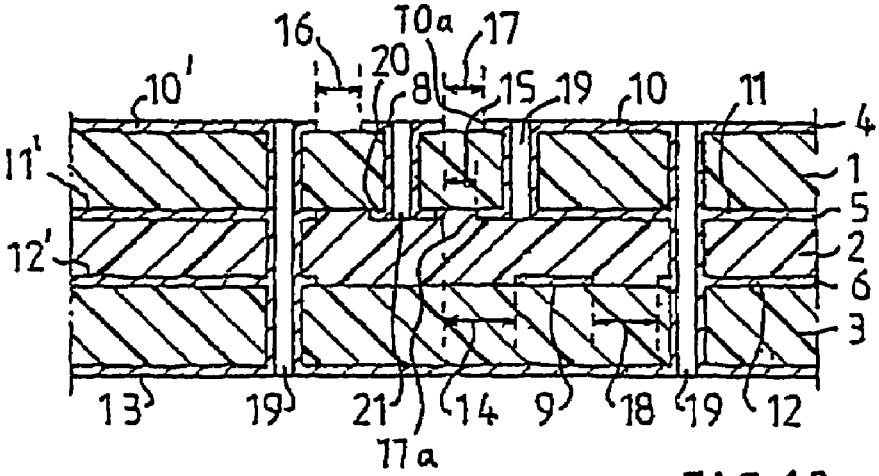

In the embodiments described above, the first line 8, whether in the form of a coplanar or a microstrip line, works in the coupler as a power carrying line. FIG. 10 shows an alternative embodiment, in which a first line is stacked, whereby an auxiliary line 20 on a second conductive layer 5 is located below a line 8 on a first conductive layer 4 and connected to the line 8 utilizing at least one, preferably a plurality of via holes 21 placed along the lines 8 and 20. This will extend the power handling capability of the line 8. Tuning ground planes 10 and 11 are supplied, whereby compensation conditions for a wide variety of weak couplings can be achieved by suitable adjustment of the horizontal distance 15 between the tuning ground plane 11 and the first line 8, as well as the horizontal distance 17 between the tuning ground plane 10 and the first line 8.

Preferably, an electrical length of the directional coupler, i.e. the distance on which the first and the second lines are coupled, is a quarter or less of length of the propagated wave—how to calculate this length for two modes propagated with different velocities see the above mentioned article: K. Sachse, A. Sawicki, Quasi-ideal multilayer two- and three-strip directional couplers for monolithic and hybrid MICs, IEEE Trans. MTT, vol. 47, No. 9, Sep. 1999, pp. 1873-1882.

The configurations in FIGS. 3, 7, and 9 where the microstrip line 8 and the stripline 9 are, apart from being horizontally shifted, placed at a vertical distance from each other, with the ground plane 11 separating these two propagation media, provide for manufacturing couplers of high scale of integration, with a relatively small size, which is a big advantage in many applications.

Figure 11:
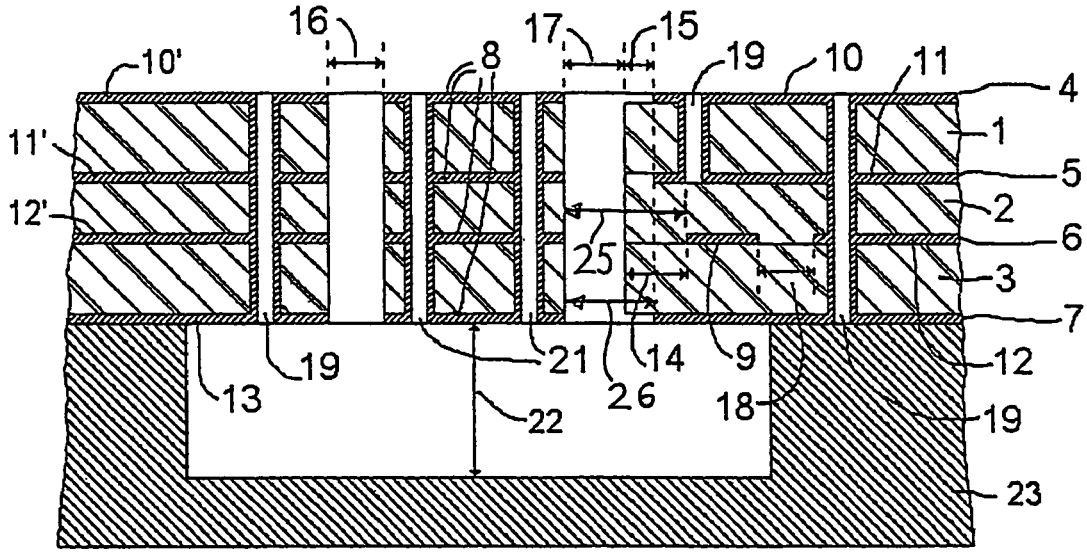

FIG. 11 shows an alternative embodiment in which dielectric material beside the first line 8 is removed along the first line 8. The horizontal distances 16 and 17 indicate the width of removed areas. Thereby, the region between the first and the second lines 8, 9 comprises partly air. In general any suitable gas can be present in said region.

The first line 8 is suspended over an external conductive chassis 23 at the vertical distance 22. The external conductive chassis 23 is connected to the lower ground plane 13. The first line 8 is composed of four printed lines placed on conductive layers 4, 5, 6, and 7, and connected by means of plurality of via-holes 21 placed along the first line 8. The coupling level between the first line 8 and the second line 9 depends mainly on the distance 25 between the lines, i.e. the sum of the distances 17 and 14. The first line 8 in this embodiment has low insertion loss and can carry high power of a transmitted signal. There are almost no losses in the dielectric material placed between conductive layers of the first line 8, because these conductive layers have the same electrical potential.

Compensation of the directional coupler in the embodiment shown in FIG. 11 is possible due to tuning feature of tuning ground planes 10, 11, and 13, placed at a distance 15 from the edge of a dielectric material 1, 2, 3, surrounding the second line 9, i.e. a distance 26 from the first line 8. In other words, by adjusting the distances 15 between the respective edge of each ground plane 10, 11, 13 and the boundary between the gas and the dielectric layers 1, 2, 3, compensation of the coupler can be obtained. The distance 15 can be kept the same for each ground plane 10, 11, and 13, or can be different for each of these ground planes.

The directional coupler shown in cross sectional view in FIG. 11 can be applied in highly integrated modules where high power is transmitted through the first line 8, whereby some parts of a circuit are placed on microstrip-type transmission medium created by conductive layers 4 and 5, and other parts on strip-type transmission medium created by conductive layers 5, 6, and 7. The length of a directional coupler built in this configuration is shorter than the one built using air-filled transmission medium, because effective dielectric constant of one of the modes propagated in the structure is almost equal to the dielectric constant of the dielectric material 2 and 3, surrounding the second line 9.

Figure 12:
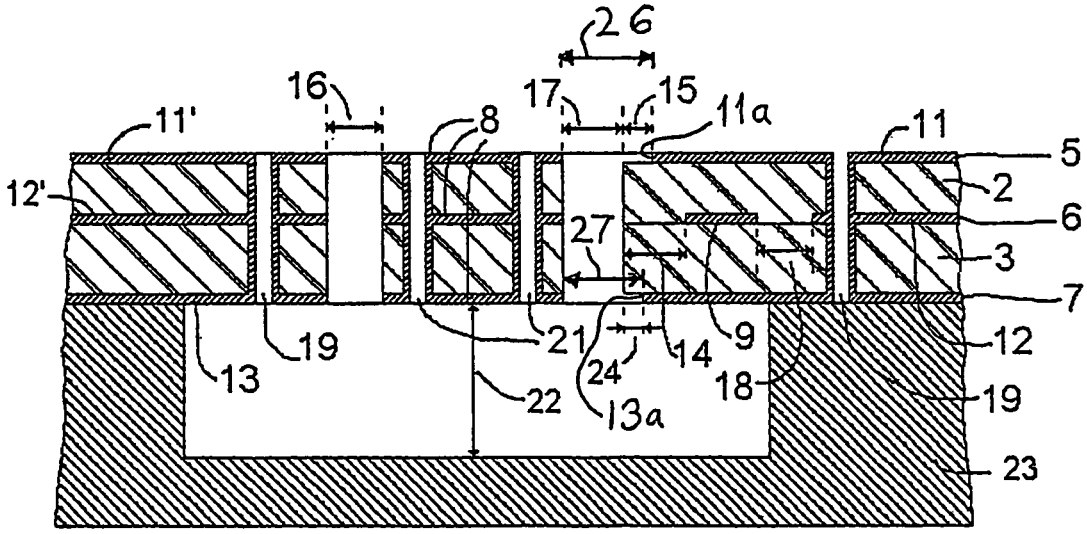

Another alternative embodiment presents a directional coupler shown in a cross sectional view in FIG. 12. This coupler is convenient for construction of stand-alone couplers. The only difference between this embodiment and the one shown in FIG. 11 is the lack of microstrip-type transmission medium. The quasi air-filled first line 8 and strip-type second line 9 are used to compose the coupler. Compensation of the coupler is possible by proper adjusting of horizontal distances 15, and 24, between the edges 11*a*, 13*a* of ground planes 11 and 13, and the edge of a dielectric material surrounding the second line 9, i.e. the distances 26, 27 between the ground planes 11, 13 and the first line 8. The distances 15 and 24 can be set equal or different.

Figure 13:
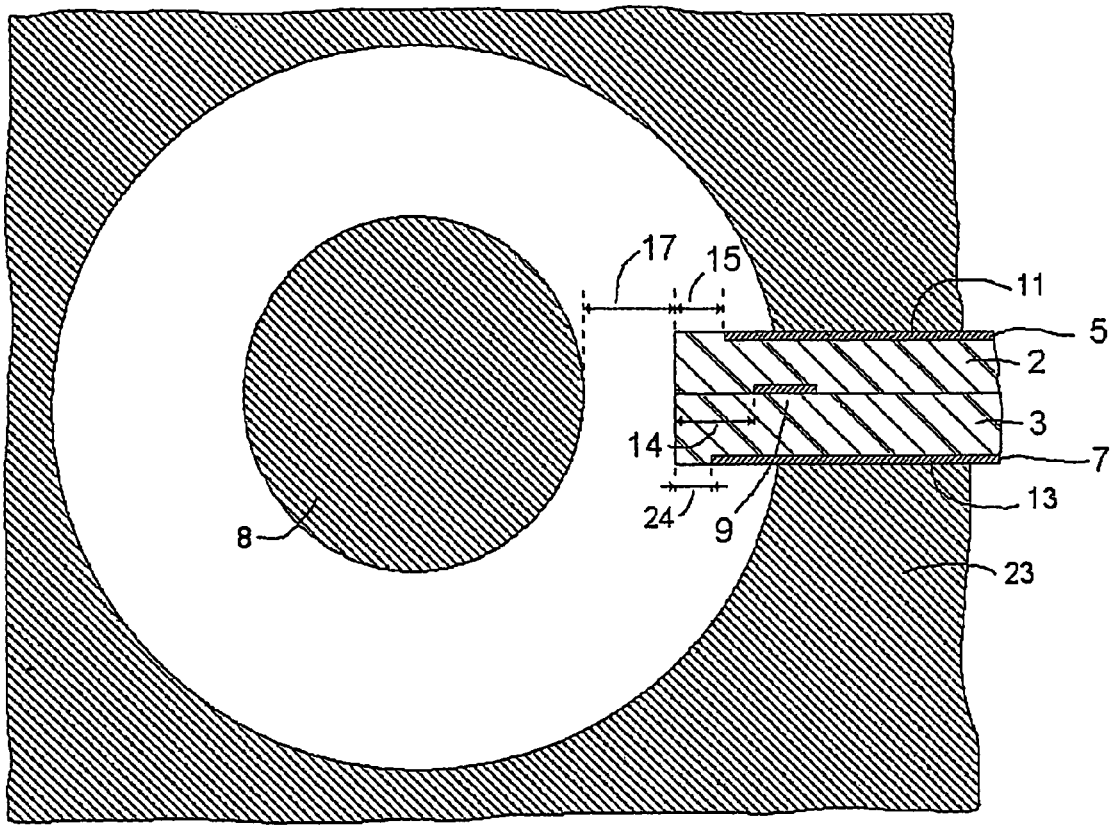

Because the first line 8 in the embodiments presented in FIG. 11 and FIG. 12 is quasi air-filled, it is possible to replace the first multilayer printed line 8 by anyone suspended in air-filled medium. FIG. 13 shows yet another embodiment of the invention, where a coaxial line inner conductor is applied as an exemplary air-filled first line 8.

Plenty of other cross section shapes of the first line 8 are allowed without affecting the essential features of the directional coupler, e.g. square, rectangular or triangular. In FIG. 13, a strip-type transmission medium is present, composed of the second line 9 and ground planes 11 and 13. This embodiment can be supplemented by a microstrip-type transmission medium similar to the one shown in FIG. 11, and comprising in FIG. 11 the conductive layers 4 and 5.

Figure 14A:
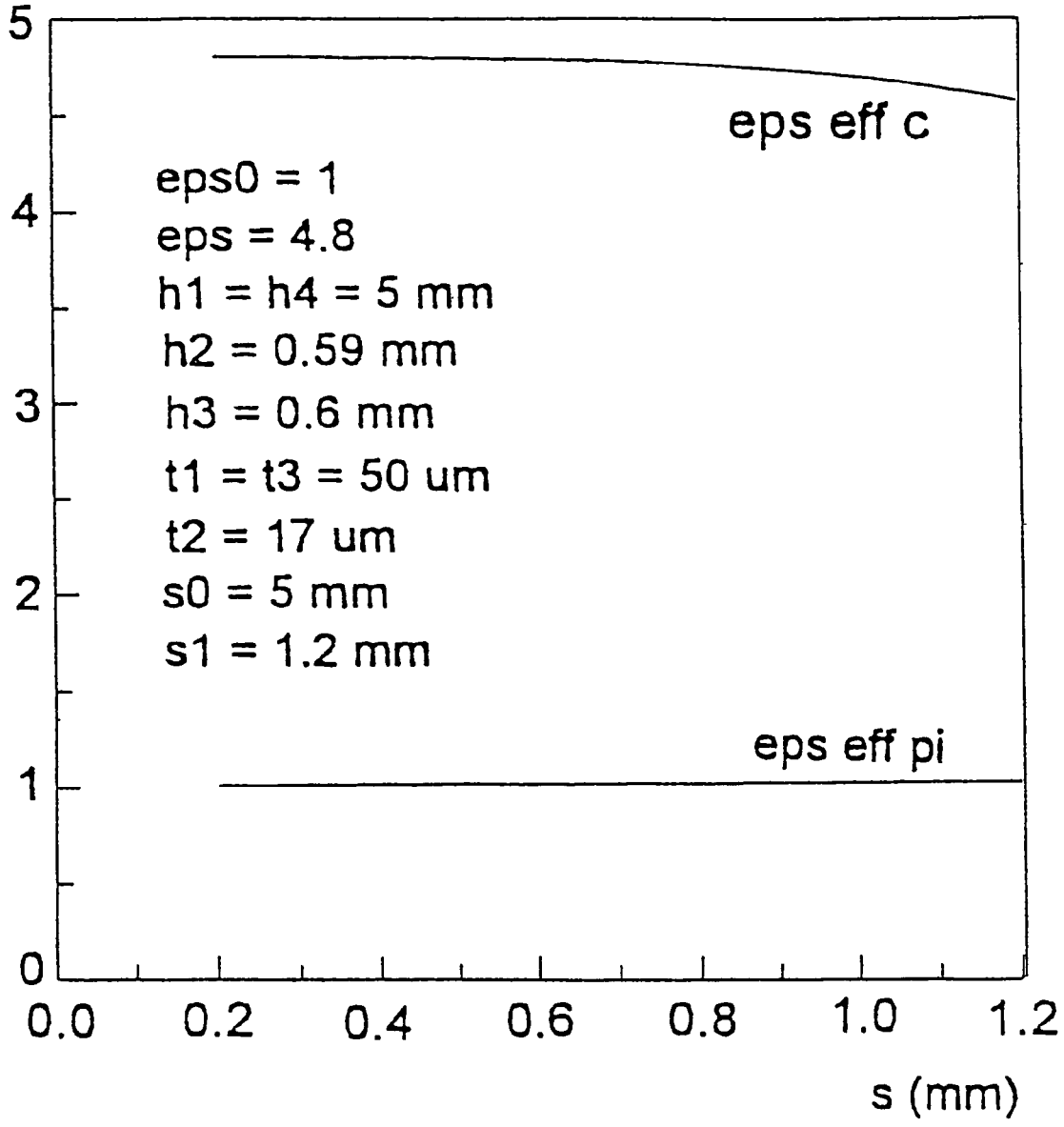
FIG. 14*a* shows a diagram with effective dielectric constants calculated for two orthogonal modes propagated in the coupled lines in the configuration shown in FIG. 13.
Figure 14B:
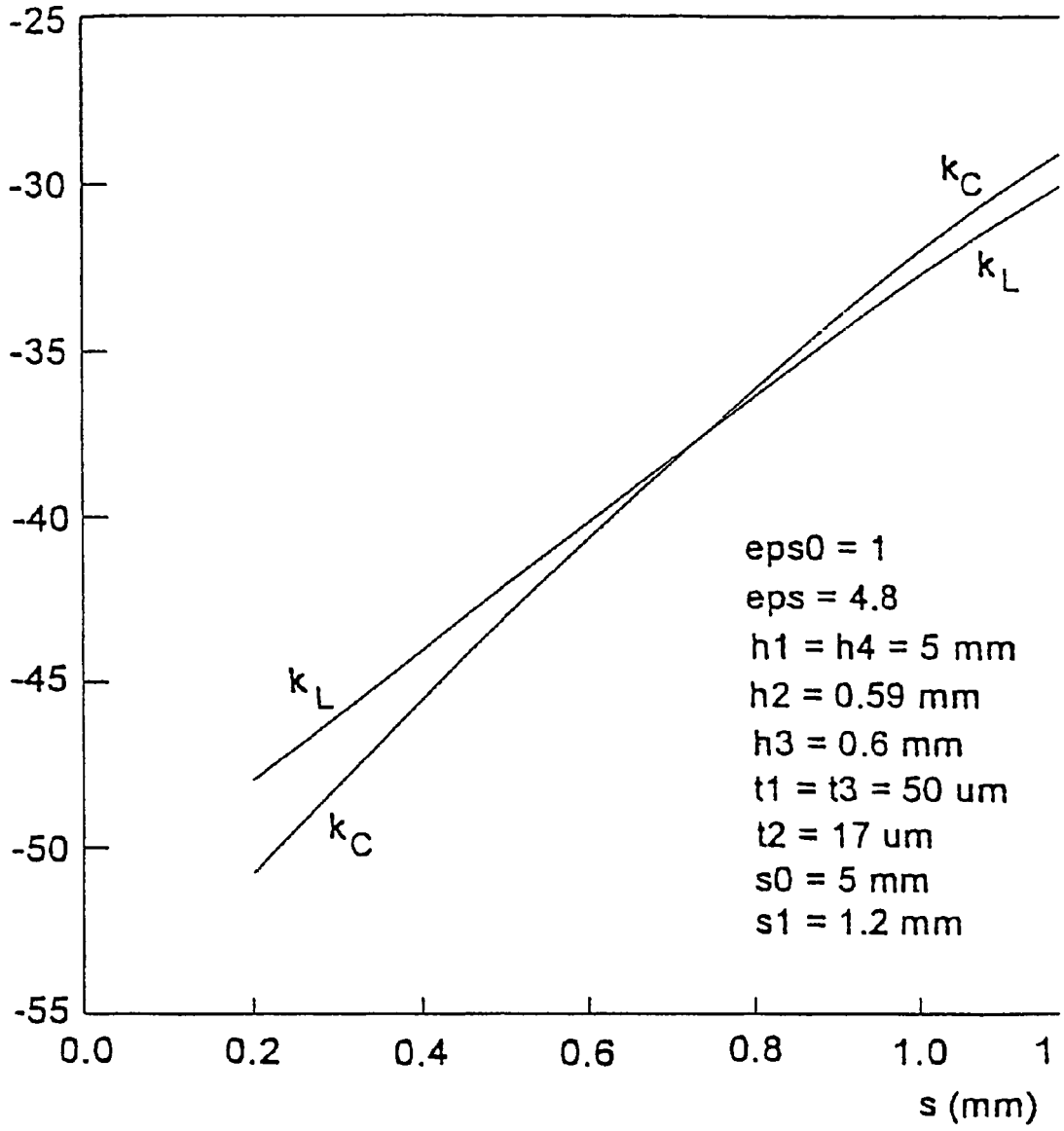
FIG. 14*b* shows a diagram with coupling coefficients for the directional coupler shown in FIG. 13.
Figure 14C:
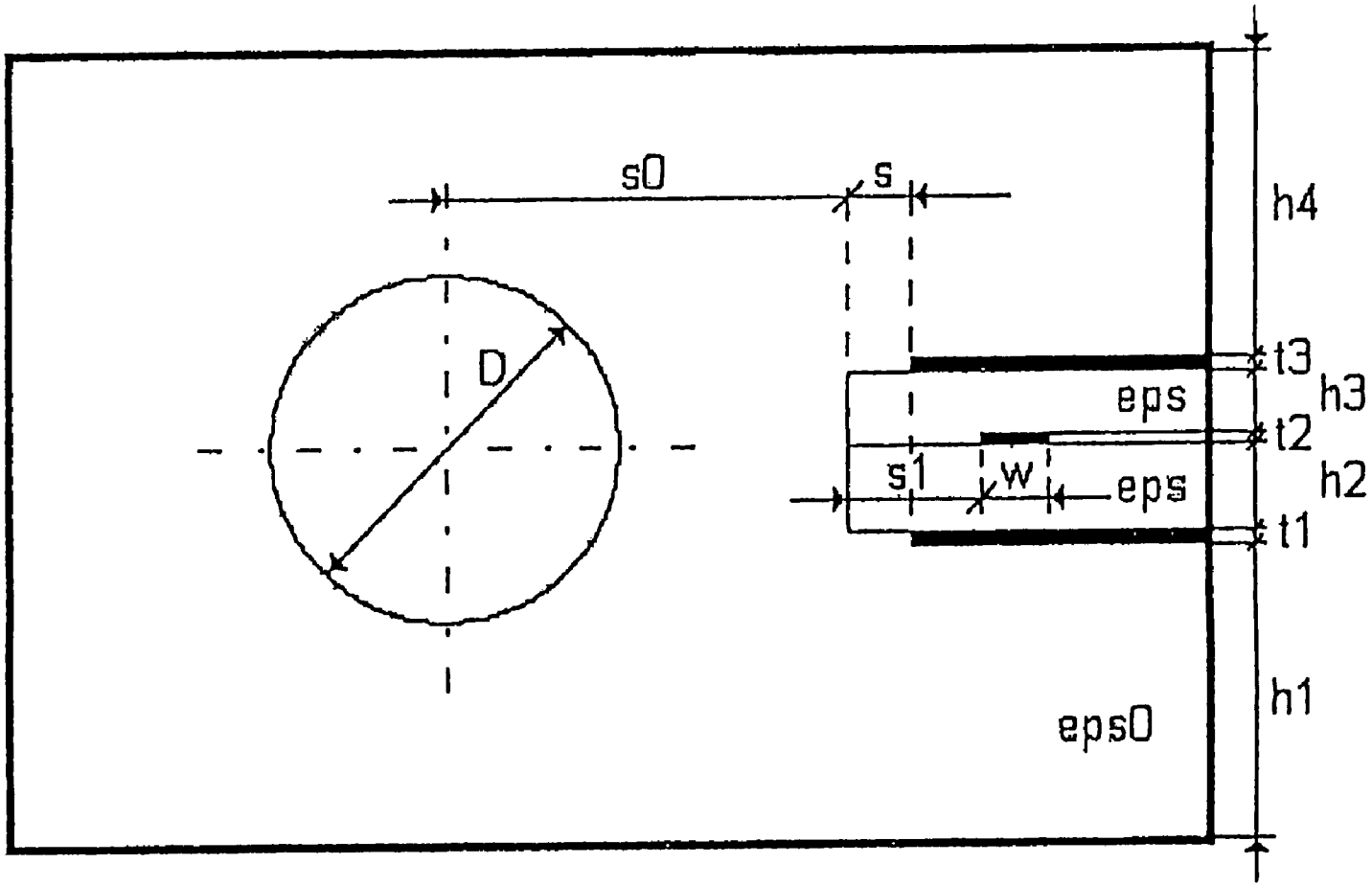
FIG. 14*c* shows a cross-section similar to the one in FIG. 13 to explain variables in the diagram of FIGS. 14*a* and 14*b*.

Surprisingly it has been found that couplers built according to the embodiments presented in FIGS. 11, 12, and 13 can be compensated. The difference in propagation velocities of two orthogonal modes propagated in the coupled lines is even larger in said embodiments than in the embodiments presented with reference to FIGS. 3, 5, 7, 9, and 10. This is illustrated in FIG. 14*a*-14*c* in which inductive and capacitive coupling coefficients kL, kC, (see FIG. 14*b*) and effective dielectric constants eps eff c, eps eff pi for two orthogonal modes propagated in the coupled lines in the configuration similar to the one shows in FIG. 13, and a cross-section similar to the one in FIG. 13 to explain variables in the diagrams, are presented. (Dissimilarities between the configurations in FIGS. 13 and 14*c* are not essential.) Note that the coupler is compensated for s being about 0.75 mm, where curves of coupling coefficients cross each other. Also, note that effective dielectric constants of two modes are almost equal to the dielectric constants of two different media surrounding the coupled transmission lines: 1 for air surrounding the coaxial line, and eps for the dielectric of the strip line.

Figure 15:
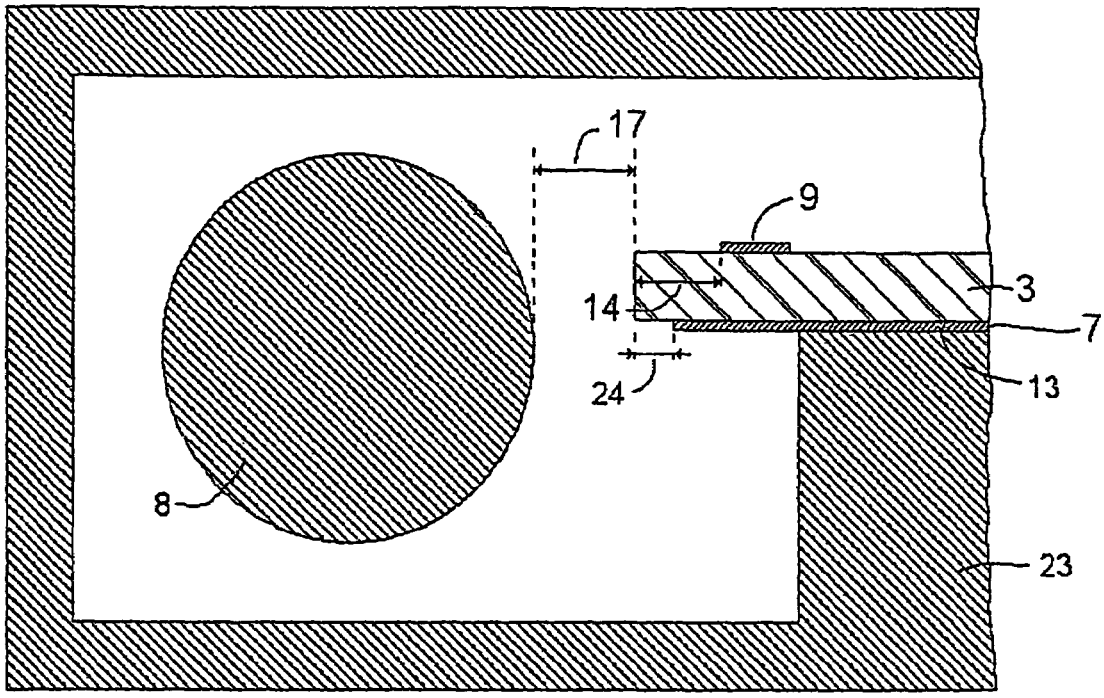
FIG. 15 shows a sectional view of a coupled lines directional coupler according to a further embodiment, sectioned perpendicular to the coupled lines.

Yet another alternative embodiment is presented in FIG. 15. This includes a simple coaxial line-microstripline configuration. The coupler is compensated by proper adjustment of the horizontal distance 24 between the left vertical edge of the ground plane 13 and the left vertical edge of the dielectric layer 3.

Above, it has been mentioned that widths of the first and the second lines can be adjusted to match the first and the second line to desired impedance, preferably 50 ohms. In addition to this, the distances between ground planes surrounding the lines can be adjusted, to contribute to the matching of the first and the second line to 50 ohms.

The invention claimed is:

1. A directional coupler comprising:

coupled lines including a first line and a second line, and at least one ground plane, wherein at least one of the ground planes is a tuning ground plane and a distance, between the first line and the second line and each distance between the first line and the respective tuning ground plane are adapted so as to contribute to a desired coupling level under compensation conditions, wherein an electrical length of the directional coupler is a quarter or less of length of a wave propagated in the directional coupler, and wherein a region between the first and the second lines comprises at least partly a gas, and at least one dielectric layer is arranged between the second line and the at least one tuning ground plane, whereby each distance between the first line and the respective tuning ground plane is dependent on the respective distance between each tuning ground plane and a boundary between the gas and the dielectric layer.

2. A directional coupler according to claim 1, wherein the respective width of the first line and/or the second line is adapted so as to contribute to a desired coupling level under compensation conditions.

3. A directional coupler according to claim 1, wherein the distance between the first line and the second line refers to a horizontal distance in a direction parallel to the at least one ground plane and perpendicular to a longitudinal direction of the coupled lines.

4. A directional coupler according to claim 1, wherein the second line and the at least one tuning ground plane are located on the same side of the first line.

5. A directional coupler according to claim 1, comprising at least two conductive layers located on the same side of the first line, whereby the at least one dielectric layer is interposed between the conductive layers.

6. A directional coupler comprising:

coupled lines including a first line and a second line, and at least one ground plane, wherein at least one of the ground planes is a tuning ground plane and a distance between the first line and the second line and each distance between the first line and the respective tuning ground plane, are adapted so as to contribute to a desired coupling level under compensation conditions, wherein an electrical length of the directional coupler is a quarter or less of length of a wave propagated in the directional coupler, and wherein the first line comprises at least two strips separated in a vertical direction and electrically joined by at least one connection.

7. A method for achieving coupling in a directional coupler under compensated conditions, the coupler including coupled lines, including a first line and a second line and at least one ground plane, the method comprising:

choosing a distance between the first line and the second line, and each distance between the first line and an edge of at least one of the ground planes, so as to contribute to a desired coupling level under compensation conditions, wherein an electrical length of the directional coupler is a quarter or less of the wavelength of a wave propagated in the directional coupler, and wherein the second line and said respective edge of at least one of the ground planes are positioned on the same side of the first line.

8. A method according to claim 7, wherein a region between the first and the second lines comprises at least partly a gas, and at least one dielectric layer is arranged between the second line and the at least one tuning ground plane, whereby each distance between the first line and the respective tuning ground plane is dependent on the respective distance between each tuning ground plane and a boundary between the gas and the dielectric layer.

9. A method according to claim 7, wherein the respective width of the first line and/or the second line are chosen so as to contribute to a desired coupling level under compensation conditions.

10. A method according to claim 7, wherein the distance between the first line and the second line refers to a horizontal distance in a direction parallel to the at least one ground plane and perpendicular to a longitudinal direction of the coupled lines.

* * * * *